US005253602A

United States Patent [19]

Moriarty

[11] Patent Number: 5,253,602

[45] Date of Patent: Oct. 19, 1993

[54] APPLIANCE FOR PLUGGING A HOLE IN A BOAT HULL

[76] Inventor: John B. Moriarty, Unit 1, 15 Carrathool Place, Mooloolaba, Queensland 4557, Australia

[21] Appl. No.: 802,688

[22] Filed: Dec. 9, 1991

[30] Foreign Application Priority Data

Dec. 13, 1990 [AU] Australia ..... PK3887

[51] Int. Cl.[5] ..... B63B 43/16

[52] U.S. Cl. ..... 114/227; 114/229

[58] Field of Search ..... 114/222, 227, 228, 229; 135/22, 23, 24

[56] References Cited

U.S. PATENT DOCUMENTS

| | | | |
|---|---|---|---|
| 1,249,422 | 12/1917 | Kook | 114/227 |
| 2,220,085 | 11/1940 | Dirschel | 114/227 |
| 2,365,488 | 12/1944 | Nelson | 114/227 |
| 2,574,859 | 11/1951 | Chisholm | 114/227 |
| 4,329,132 | 5/1982 | Melvold et al. | 114/227 |
| 4,527,500 | 7/1985 | Fuerst | 114/229 |
| 4,951,590 | 8/1990 | Kassbaum | 114/227 |

FOREIGN PATENT DOCUMENTS

| | | | |
|---|---|---|---|
| 188561 | 10/1927 | United Kingdom | 114/227 |
| 1450861 | 9/1976 | United Kingdom . | |
| 2217591 | 1/1989 | United Kingdom . | |

*Primary Examiner*—David M. Mitchell
*Assistant Examiner*—Stephen P. Avila
*Attorney, Agent, or Firm*—Cushman, Darby & Cushman

[57] ABSTRACT

An appliance for plugging a hole in a boat hull comprises a threaded stem (3), a tubular slide (4) sleeved upon the stem (3), a hub (5) fixed to a distal end of the stem (3), a proximal abutment flange (6) on the slide (4), a distal abutment flange (7) having a converging distal surface on the slide (4), a collar (8) slideable along the slide (4) between the abutment flanges, a plurality of ribs (10), each pivoted at one end to the collar (8) and able to radiate therefrom in the manner of wheel spokes, a like plurality of control arms (11) respectively pivoted at one end to the ribs (10) at a position intermediate the rib ends and pivoted at their other ends to the hub (5), and an impervious membrane (12) secured to the ribs (10) and filling the spaces therebetween when the ribs are radiating from the collar (8). Having been thrust through a hole in a boat hull the slide (4) may be moved outwardly to cause the ribs (10) to swing out and the membrane (12) to cover the hole. Thereafter a cover (19) may be attached to the stem (3) by a combined handle/nut (14) and an bladder (24) inflated to form an effective seal preventing the ingress of water.

6 Claims, 3 Drawing Sheets

APPLIANCE FOR PLUGGING A HOLE IN A BOAT HULL

BACKGROUND OF THE INVENTION

This invention relates to apparatus for the emergency plugging of a hole in the hull of a boat.

A number of emergency plugging devices for that purpose in the general nature of an umbrella have been proposed hitherto. For example, the device of British patent 1,450,861 to B. Simpson, in which the device is thrust outwardly through the hole in the boat, then "opened", that is to say unfurled or extended in the manner of an umbrella, and allowed to come back against the outer surface of the hull to at least diminish the inflow of water. It has been found that such known devices are difficult to use in practice because it is quite hard to open the device against the pressure of the inrushing water.

In prior attempts to achieve rapid opening it has been proposed to utilise spring loaded mechanisms, for example the device of British patent application 2,217,591 of G. W. Kassbaum, but such mechanisms rapidly corrode and freeze up in a marine environment and are likely to be inoperative when called upon in an emergency after a long period of non-use.

SUMMARY OF THE INVENTION

Therefore, an object of the present invention is to provide a simple and robust mechanism, devoid of springs and close fitting moving parts.

By way of example, an embodiment of the above-described invention is described in more detail hereinafter, with reference to the accompanying drawings.

DESCRIPTION OF THE PREFERRED EMBODIMENT

Figure 1:
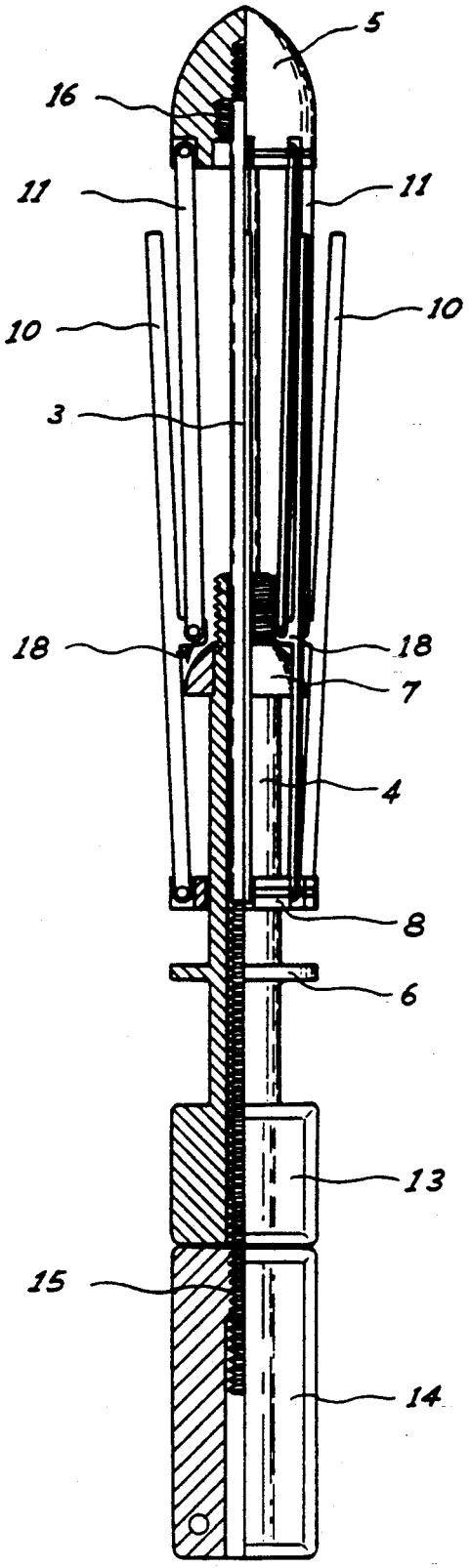
FIG. 1 is a quarter sectioned side elevation of an appliance according to the invention when in its collapsed position.

The illustrated appliance comprises a rigid stem 3, a tubular slide 4 slideable along the stem 3, a hub 5 fixed to the distal end of the stem 3, a proximal abutment flange 6 on the slide 4, a distal abutment flange 7 on the slide 4, a collar 8 slideable along the slide 4 between the flanges 6 and 7, a plurality of ribs 10 pivoted on the collar 8, a like plurality of control arms 11 pivoted to the hub 5 and the respective ribs 10, and an impervious membrane 12 (omitted from FIG. 1) secured to the ribs 10 in the manner of an umbrella canopy.

Preferably the slide 4 has a handle 13 formed on its inner end, and the stem 3 is provided with a complementary handle 14. The handle 14 is connected to the stem 3 by a threaded socket 15 and is thus readily detachable.

The distal end of the slide 4 is threaded and may engage within a threaded socket 16 in the hub 5.

Figure 2:
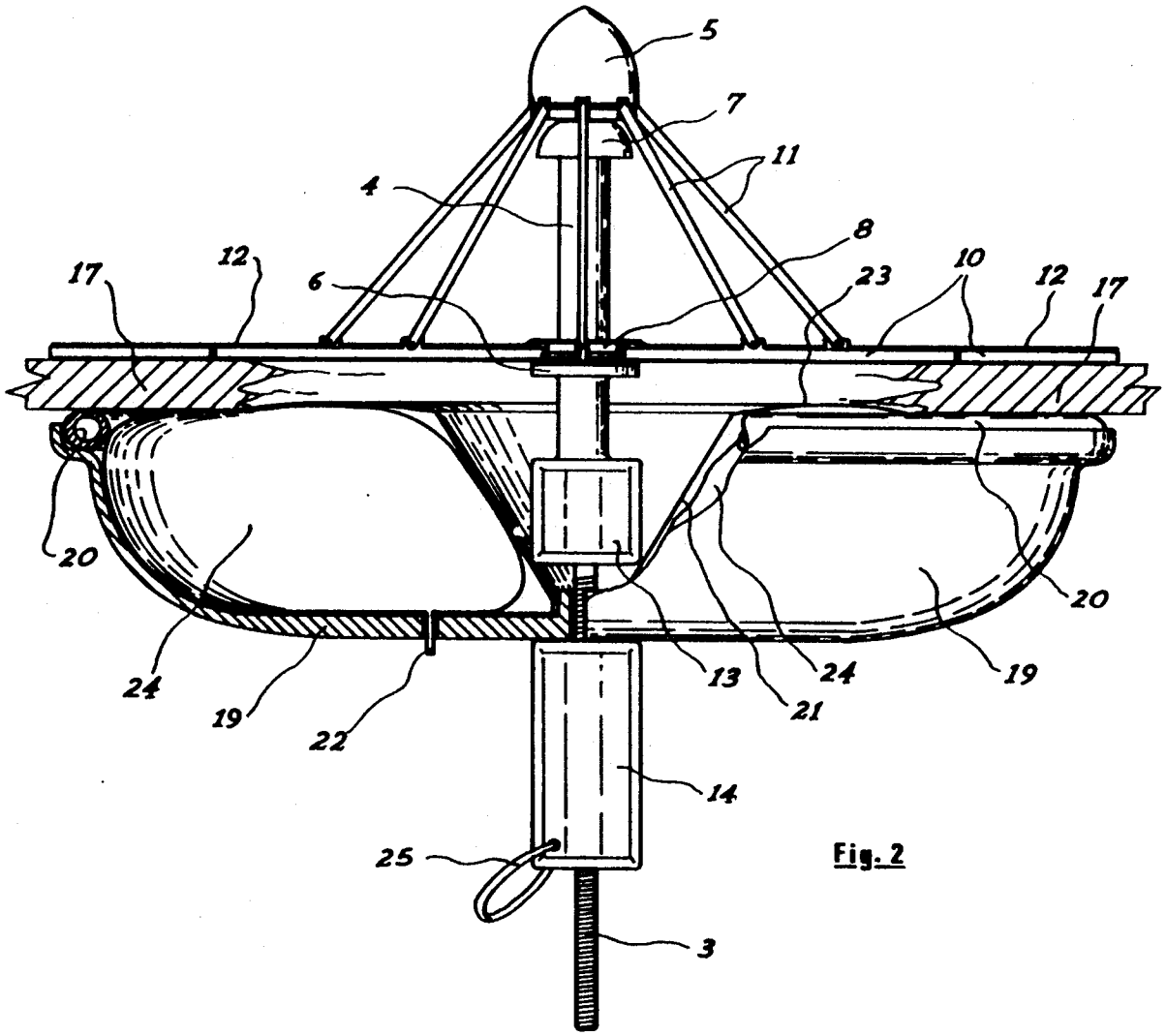
FIG. 2 is a view similar to FIG. 1 showing the appliance in its extended, in-use position.
Figure 3:
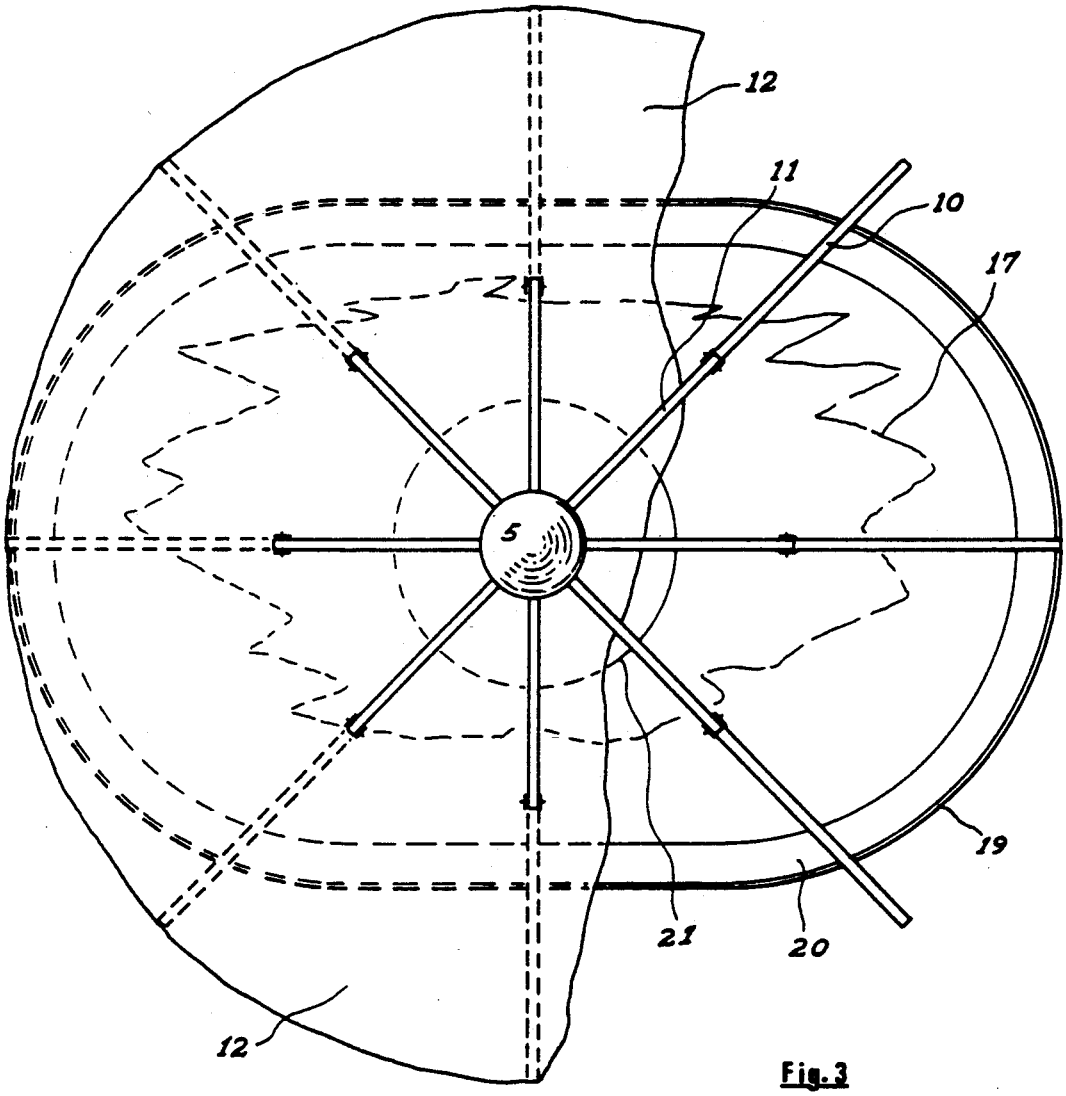
FIG. 3 is a partly sectioned end view of the appliance shown in FIG. 2.

The functioning of the appliance may now be described. In the event that a boat hull 17 (see FIG. 2) is holed the appliance in its collapsed or furled condition as seen in FIG. 1 may be thrust hub first through the hole. The slide 4 may then be slid outwardly (with reference to the hull 17) by a person grasping and separating the handles 13 and 14.

As the slide 4 moves outwards, the converging distal face of the distal abutment 7 strikes and separates coacting abutments 18 integral with the pivot connections between the ribs 10 and the control arms 11. This "breaks" the strutting action of the control arms 11 and water flowing into the space between the ribs 10 and the stem 3 causes the ribs to swing to the extended position shown in FIG. 2, wherein the membrane 12 is unfurled and covers the hole in the hull 17.

The ribs 10 are firmly held in the extended position by engaging the end of the slide 4 in the socket 16 to enable the abutment flange 6 to support the collar 8.

The handle 14 may then be removed and a cover 19 and gasket 20 put into position and held in place by replacement of the handle 14.

In some embodiments the cover 19 may be provided with a valved nozzle to enable the space on the distal side of the plate to be filled with a hard setting, self-expanding foam or other filler medium.

Alternatively, and preferably, an annular inflatable bladder 24 is provided disposed within the space between the cover 19 and the ribs 10 and encircling the stem 3 within that space. The bladder 24 may have a conventional inflation valve or stem 22 protruding from it through a clearance hole piercing the cover 19, to enable the bladder to be inflated after the cover has been secured in position. Once so inflated the bladder fills that space and so seals the hole in the hull. If an inflatable bladder is present the cover 19 preferably has one or more vent holes through it to enable air to escape from the cover as the bladder expands.

For preference a tough but somewhat pliable mesh or plastics sheet liner 23 may be interposed between the bladder 24 and the ribs 10 to prevent excessive bulging of the bladder between the ribs when the bladder is inflated, and to protect the bladder from sharp objects.

To assist in the emplacement of the cover 19 and deflated bladder, a collapsible guide sleeve 21 may extend fixedly from the cover 19 through the central opening of the deflated bladder and the said liner, if present, which sleeve may loosely surround the stem 3 and handle 13 to prevent them fouling the bladder as the cover and bladder are offered up to the stem. That guide sleeve is sufficiently fragile to collapse when the bladder is inflated so as not to impair the sealing action thereof.

A wrist band 25 may be provided on the handle 14 to decrease the possibility of a person inadvertently losing the appliance outboard when thrusting it through the hole in the hull.

If desired a separable or frangible strap, for example a strap having its ends joined together by so called Velcro fastening medium, may encircle the ribs 10 when the appliance is furled as in FIG. 1, to hold the ribs together. That band may be joined by a pull cord to the handle 14 to enable it to be pulled free of the ribs after the furled appliance has been thrust through the hole in the hull.

I claim:

1. An appliance for plugging a hole in a boat hull comprising a stem, a tubular slide sleeved upon said stem, a hub fixed to a distal end of said stem, a proximal abutment flange on said slide, a distal abutment flange having a converging distal surface on said slide, a collar slideable along said slide between said abutment flanges, a plurality of ribs, each pivoted at one end to said collar and able to radiate therefrom in the manner of wheel spokes, a like plurality of control arms respectively pivoted at one end to said ribs at a position intermediate the rib ends and pivoted at their other ends to said hub, and an impervious membrane secured to said ribs and filling the spaces therebetween when the ribs are radiating from said collar.

2. An appliance according to claim 1 wherein a proximal end of said stem is threaded to receive an internally threaded handle and wherein a rigid cover adapted to cover said hole internally of said hull is secured to said stem by said handle acting as a clamping nut.

3. An appliance according to claim 2 wherein said cover is provided with a valved nozzle to enable a space on the distal side of the cover to be filled with a hard setting, filler medium.

4. An appliance according to claim 2 further comprising an annular inflatable bladder providing a seal between the distal side of said cover and the hull of the boat.

5. An appliance according to claim 2 further comprising a pliable sheet covering a proximal side of said ribs, and an annular inflatable bladder providing a seal between said cover and said sheet.

6. An appliance according to claim 1 wherein a screwed socket is formed in a proximal side of said hub and wherein a distal end of said stem able to be received by said socket is complementarily threaded to enable said stem to be secured to said hub.

* * * * *